United States Patent [19]

Rudy

[11] 4,066,451

[45] Jan. 3, 1978

[54] CARBIDE COMPOSITIONS FOR WEAR-RESISTANT FACINGS AND METHOD OF FABRICATION

[76] Inventor: Erwin Rudy, 15750 NW. Oak Hills Drive, Beaverton, Oreg. 97005

[21] Appl. No.: 658,346

[22] Filed: Feb. 17, 1976

[51] Int. Cl.[2] ..... B22F 3/00; C22C 29/00

[52] U.S. Cl. ..... 75/240; 75/241; 75/123 J; 75/123 R; 75/170; 75/176; 75/203; 423/439; 423/440

[58] Field of Search ..... 75/176, 123 J, 123 R, 75/170, 203, 240, 241; 423/439, 440; 29/182.7

[56] References Cited

U.S. PATENT DOCUMENTS

| | | | |
|---|---|---|---|
| 3,479,155 | 11/1969 | Rudy | 29/182.7 |
| 3,677,722 | 7/1972 | Rymas | 75/204 |
| 3,840,367 | 10/1974 | Rudy | 29/182.7 |
| 3,842,581 | 10/1974 | Schedler | 29/182.7 |

FOREIGN PATENT DOCUMENTS

| | | | |
|---|---|---|---|
| 1,326,769 | 8/1973 | United Kingdom | 423/440 |
| 890,757 | 3/1962 | United Kingdom | 423/440 |

*Primary Examiner*—Brooks H. Hunt
*Attorney, Agent, or Firm*—Oliver D. Olson

[57] ABSTRACT

Refractory, hard carbide alloys, intended primarily as replacement for the cast eutectic WC + $W_2C$ tungsten carbides currently used as hard components in wear-resistant facings, consist of fine-grained and hard two-phase mixtures of subcarbide, $(Mo,W)_2C$, and hexagonal monocarbide (Mo,W)C, solid solutions, and are formed by solid state decomposition of the pseudocubic, $\eta$-$(Mo,W)_3C_2$, or cubic $\alpha$-$(Mo,W)C_{1-x}$ solid solutions. The carbide alloys of the invention can be combined with low-melting metal binders to form cemented carbide alloys of at least equivalent wear-resistance to alloys using the eutectic tungsten carbides.

6 Claims, 17 Drawing Figures

CARBIDE COMPOSITIONS FOR WEAR-RESISTANT FACINGS AND METHOD OF FABRICATION

BACKGROUND OF THE INVENTION

This invention relates to refractory, hard carbide alloys for use in wear-resistant facings, and more particularly to such alloys, and their method of fabrication, as replacement for the cast eutectic WC + $W_2C$ tungsten carbides.

In spite of the advent of sintered monocarbides of the refractory transition metals cemented by cobalt and nickel, the exceptional wear-resistance of cast WC + $W_2C$ alloys has retained a large market for this carbide in wear-facings for earth-moving, oil drilling, and mining applications. In addition to the high hardness of the alloy constituents, the resistance of the cast structure to abrasive wear is in particular attributable to the small grain size of the subcarbide and monocarbide phases which, in practice, is achieved by rapid chilling of the eutectic melt, usually by pouring the melt into water-cooled copper molds. A significant barrier in the commercial use of tungsten carbide hard facing alloys is the high cost and uncertain supply of the raw materials, and additional problems are posed by the considerable fluctuations in the grain size, and hence quality, of the commercially available products. The coarse grain size can result from the known rapid recrystallization of the WC + $W_2C$ mixture at subsolidus temperatures to form less hard and wear-resistant alloys, a process which is difficult to control economically.

SUMMARY OF THE INVENTION

In its basic concept, this invention involves the fabrication of hard, two-phased mixtures of subcarbide, $(Mo,W)_2C$ and hexagonal monocarbide (Mo, W)C solid solutions by solid state decomposition of the psendocubic, $\eta$-$(Mo, W)_3 C_2$, or cubic $\alpha$-$(Mo, W)C_{1-x}$ solid solutions.

Co-pending application Ser. No. 581,787, filed 29 May 1975 and entitled "Cemented Carbides Containing the hexagonal MoC," of which I am a co-inventor has as its object cemented, stoichiometric monocarbide solid solutions (Mo, W)C. The preparation of the master carbide alloys by nucleation of the monocarbide in the cubic or pseudocubic carbide, and subsequent growth of the stoichiometric monocarbide by reactive combination by carbon and subcarbide at the monocarbide in the presence of a ferrous metal diffusion aid, is described.

I now have extended the studies of Mo-W-C alloys and particularly concentrated on alloys containing between 37 and 42 atomic percent carbon, i.e. on the composition range between the subcarbide and monocarbide. These studies have revealed that, within certain composition limits and under defined conditions of heat treatment, extremely hard and wear-resistant phase mixtures consisting of subcarbide, $M_2C$, and hexagonal monocarbide, MC, can be prepared by solid state decomposition of the pseudocubic $\eta$-$(Mo, W)_3 C_2$, or the cubic $\alpha$-$(Mo, W)C_{1-x}$, solid solution.

When prepared from the compositions, and according to the methods specified herein, these fine-grained carbide mixtures exhibit hardness values and abrasion resistance equal or superior to that of the WC + $W_2C$ eutectic. Added advantages of the carbide alloys of this invention are their significantly lower volume cost, lower melting temperatures, and the less stringent requirements for rapid quenching rates, since the fine-grained phase mixture is either formed in a separate heat treatment step at lower temperatures; or, for alloys located within a particular composition range, the undesirable recrystallization to form coarse-grained structures is impeded by a four-phase solid state reaction occurring within the critical transformation range.

It is accordingly an object of the present invention to provide two-phased carbide alloy compositions equal or superior in hardness and abrasion-resistance to commercial cast tungsten carbides.

It is another object of the present invention to outline methods by which said two-phased alloys of the invention can be prepared in such a manner as to yield a product of consistent hardness and of reproducible quality.

It is another object of the present invention to demonstrate that the carbide alloys of the invention can be combined with low-melting metal binders to yield products with generally similar application ranges as the currently employed cast tungsten carbides.

It is a further object of the present invention to demonstrate that the use of the carbide alloys of the present invention instead of cast tungsten carbides is advantageous in steel-based hard facing electrodes, because the smaller density difference between the carbides of the invention and the steel binder provides for a lesser tendency of the carbide to settle to the bottom of the facing, and thus away from the wear-surface, during application.

The foregoing and other objects and advantages of this invention will appear from the following detailed description, taken in connection with the accompanying drawings illustrating features of preferred embodiments of the invention.

BRIEF DESCRIPTION OF THE DRAWINGS

(FIG. 4*b*) -$(Mo_{0.78}W_{0.22})C_{0.715}$; (FIG. 4*c*) -$(Mo_{0.69}W_{0.31})C_{0.71}$; (FIG. 4*d*) -$(Mo_{0.30}W_{0.70})C_{0.67}$; and (FIG. 4*e*) -$WC_{0.64}$.

FIG. 8*a* is from a facing using a commercial hard facing electrode containing 41.5 volume percent (60 wt%) cast tungsten carbide of a mesh size 40 to 120 in a steel tube. The micrograph FIG. 8*b* shows the structure of a hard facing using an electrode containing 41.5 volume percent (47.8 wt%) of a carbide of this invention with a gross composition $(Mo_{0.82}W_{0.18})C_{0.716}$ and a mesh size of 40 to 120 in a steel tube identical to that of the commercial electrode.

DESCRIPTION OF THE PREFERRED EMBODIMENTS

The gross composition of the carbide component is preferably expressed in relative mole fractions in the form $(M_xM'_{x'}, M''_{x''}\ldots)C_z$, in which M, M', M''... stand for the metal components, and the stoichiometry parameter z measures the number of gramatoms carbon for gramatom of the combined metals. The parameter z thus provides a measure for the stoichiometry of the alloy with respect to carbon, and a value of ½ defines, for example, the stoichiometric subcarbide, and a value of 1 the stoichiometric monocarbide. x, x', x''... are, respectively, the relative mole fractions (metal exchanges) of the metal constituents M, M', M''.... It is noted that 100 · x also defines a mole percent $MC_z$ or mole percent $MC_z$ -exchange, 100 · x' mole percent $M'C_z$ or mole percent $M'C_z$ -exchange, 100 · x'' mole percent $M''C_z$ or mole percent $M''C_z$ exchange, etc.

This method of defining the overall composition of the carbide component is particularly useful in describing the concentration spaces of interstitial alloys and will be used, sometimes in conjunction with compositions given in weight percent, throughout this specification.

Figure 1A:
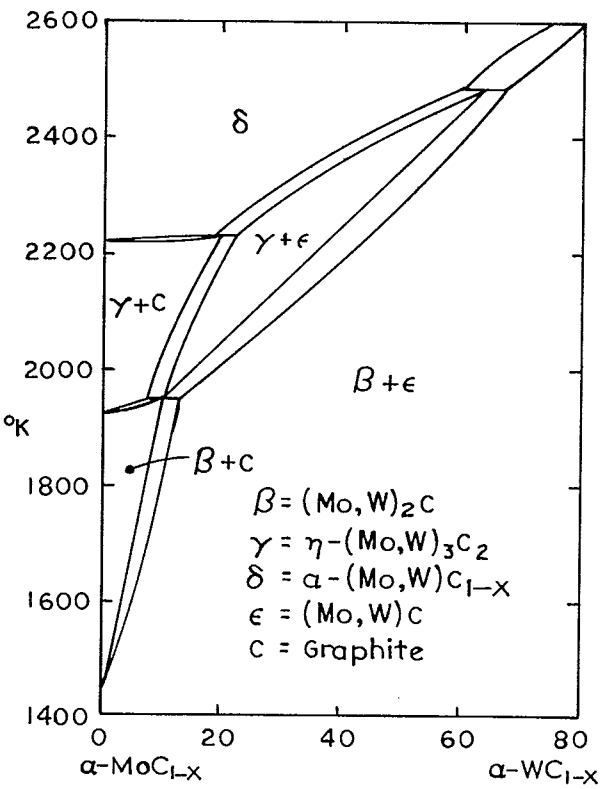
FIG. 1*a* is an equilibrium diagram which depicts a concentration section of the Mo-W-C system at approximately 40 to 41.5 atomic percent carbon ($z \sim 0.67$ to 0.71)
Figure 1B:
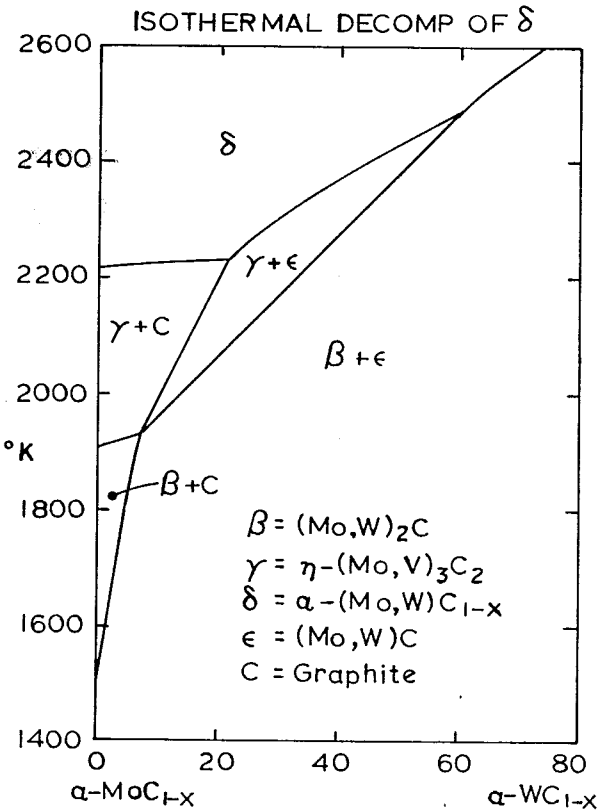
FIGS. 1*b* and 1*c* are isothermal decomposition (transformation) diagrams, for the cubic high temperature carbide solid solution with carbon contents between 38 and 42 atomic percent ($z \simeq 0.61$ to 0.72).
Figure 1C:
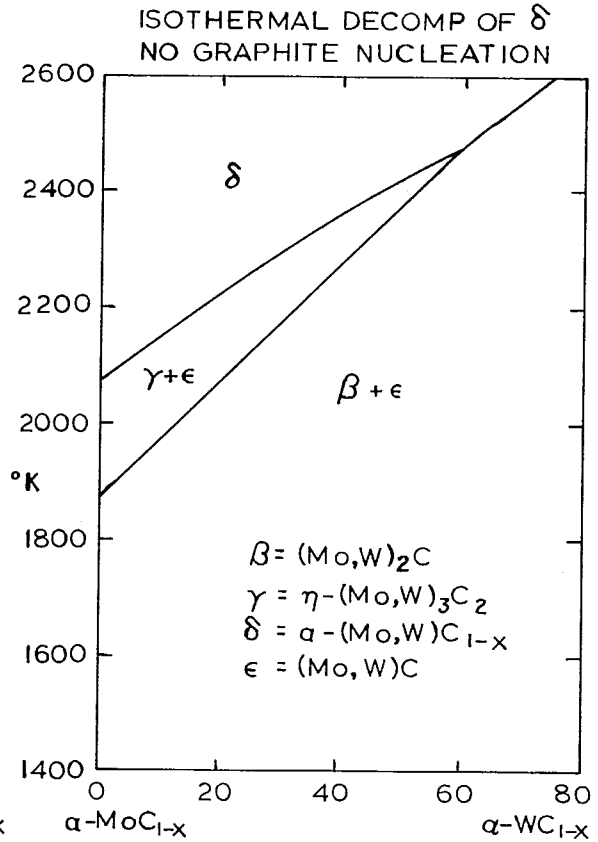

The fundamental alloying principles underlying the alloys of the invention are depicted in the graphs of FIG. 1 which show a concentration section of the system Mo-W-C in the range of the cubic monocarbide, FIG. 1*a*, and two isothermal transformation diagrams, FIG. 1*b* and FIG. 1*c*, for the cubic high temperature carbide as a function of the tungsten exchange. According to the equilibrium diagram in FIG. 1*a* the pure binary α-MoC (z~0.67 – 0.73), designated δ in the diagram, becomes unstable at 2220° K on cooling and transforms into the pseudocubic η -$Mo_3C_2$ (γ) under release of small amounts of carbon. Upon cooling through 1930° K, the low temperature stability limit of η -$Mo_3C_2$ is reached and it disproportionates into $Mo_2C$ and carbon. Under equilibrium conditions, the possibility for recombination of carbon with part of the subcarbide, $Mo_2C$, to form the hexagonal stoichiometric monocarbide MoC does only exist if the temperature is lowered to less than 1450° K; experience, however, teaches that once decomposition of η -$Mo_3C_2$ has gone to a completion, $Mo_2C$ and graphite are able to coexist in metastable equilibrium for an indefinite time period, i.e. the recombination reaction to form monocarbide is not observed in practice.

A detailed study of the transformation/decomposition reaction yielded the surprising result, however, that graphite nucleation and growth, which is the rate-determining step in the decomposition of the α -$MoC_z$ and η -$Mo_3C_2$ high temperature phases, becomes very slow at temperatures less than approximately 1700° K, while the nucleation rate of the hexagonal monocarbide increases as the high temperature stability limit of this phase is approached.

The effect of this kinetic phenomenon is an apparent enhancement of the relative stability of the hexagonal monocarbide such, that this carbide is able to coexist in (short-time) metastable equilibrium with α -$MoC_z$ and η -$Mo_3C_2$ at a much higher temperature than predicted from the equilibrium diagram, FIG. 1*a*. If thus the cubic, or pseudocubic, carbide is cooled sufficiently fast to temperatures less than 1700° K to prevent nucleation and growth of graphite, the initial products of the decomposition reactions are hexagonal monocarbide and $Mo_2C$, FIG. 1*c*.

Prolonged exposure of the monocarbide to temperatures exceeding its high temperature stability limit will result in a gradual decomposition into $Mo_2C$ and graphite, but experience shows that the phase, once formed, will endure exposure for several hours at 1500°–1650° K before decomposition is complete.

Figure 2A:
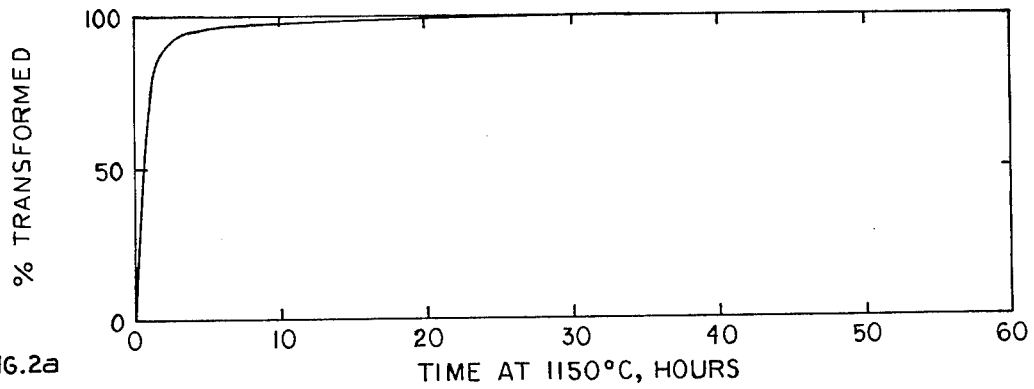
FIGS. 2*a* and 2*b* are diagrams showing, respectively, the degree of transformation of the cubic carbide and the Knoop hardness of an alloy with the gross composition $MoC_{0.72}$ as a function of the holding time at 1150° C.

Carbon-free transformation products are obtained by cooling the cubic or pseudocubic high temperature phases rapidly below the peritectic decomposition temperature of MoC, followed by an isothermal transformation of the high temperature carbides into $Mo_2C$ and MoC at temperatures in the vicinity of 1400°–1420° K. Although the rates of transformation are considerably slower at these temperatures, the reaction proceeds essentially to completion within a 10 hour time period (FIG. 2).

The principal effect of low-level (< 20 at%) tungsten substitutions in the molybdenum carbide is a rapid extension of the β + ε two-phase range towards higher temperatures, thus permitting selection of higher transformation temperatures without danger of formation of free carbon from secondary decomposition of the monocarbide. As the tungsten exchange is increased beyond about 25 atomic percent, decomposition of the cubic and pseudocubic high temperature carbides becomes very rapid and the phases are retained to room temperature only by application of severe quenching techniques.

At cooling rates at which the molybdenum-rich (< 25 at%W) high temperature carbides are fully retained, carbide alloys with tungsten exchanges between 30 to 55 at% have comparatively coarse-grained decomposition structures (FIG. 3); the alloys frequently also contain free graphite resulting from a nonequilibrium decomposition of the cubic phase on cooling. Alloys within this concentration range generally were found to require cooling rates similar to the cast tungsten carbide in order to retain structures of sufficiently fine-grain size for adequate hardness and wear-resistance. Finer-grained structures are obtained at lower carbon levels (37 to 38 atomic percent), albeit at some sacrifice in hardness because of the presence of larger proportions of the less hard subcarbide in the alloy.

At tungsten exchanges between about 55 and 70 atomic percent in the cubic carbide, decomposition of the high temperature carbide is also very rapid and cannot be prevented by moderate quenching, but the resulting structures are very fine-grained, even at moderate cooling rates (FIG. 4), and the alloys have high hardness as shown in Table 1.

TABLE 1

Knoop Hardness of Experimental Alloys and Commercial, $WC + W_2C$, Cast Carbide (200 p load).

| Alloy | State* | Knoop Hardness** |
|---|---|---|
| $MoC_{.72}$ | As-arc cast, $\delta$ | 1480 |
| $MoC_{.72}$ | Transformed at 1150° C | 2150 |
| $(Mo_{.975}W_{.025})C_{.72}$ | As-arc cast, $\delta$ | 1550 |
| $(Mo_{.975}W_{.025})C_{.72}$ | Transformed at 1240° C | 2170 |
| $(Mo_{.90}W_{.10})C_{.71}$ | As-arc cast, $\delta$ | 1600 |
| $(Mo_{.90}W_{.10})C_{.71}$ | Transformed at 1100° /1300° C | 2180 |
| $(Mo_{.80}W_{.20})C_{.71}$ | As-arc cast, $\delta$ | 1740 |
| $(Mo_{.80}W_{.20})C_{.71}$ | Transformed at 1150° /1380° C | 2290 |
| $(Mo_{.50}W_{.50})C_{.68}$ | As-arc cast, $\beta + \epsilon$ | 1990 |
| $(Mo_{.31}W_{.69})C_{.66}$ | As-arc cast, $\beta + \epsilon$ | 2710 |
| $(Mo_{.15}W_{.85})C_{.64}$ | As-arc cast, $\beta + \epsilon$ | 2090 |
| $(Mo_{.28}W_{.62}Cr_{.10})C_{.64}$ | As-arc cast, $\beta + \epsilon$ | 2730 |
| Commercial Cast Carbide, $WC + W_2C$ | | 2080 |

Legend
*$\delta$ = cubic high temperature carbide
$\beta$ = subcarbide phase
$\epsilon$ = hexagonal monocarbide phase
**Average of 10 measurements This phenomenon is linked with the occurrence of a four-phase reaction plane $\delta + \beta \rightarrow \gamma + \epsilon$ at 2220° C in which the initial reaction products resulting from the decomposition of the cubic carbide undeego a second reaction to form the $\eta$ -(Mo, W)$_3$ $C_2$ carbide, with the later carbide in turn decomposing at somewhat lower temperatures into subcarbide and monocarbide. The reaction sequence, and the presence of a multiphase mixture in the critical transformation range, are the main factors responsible for impeding grain growth of the subcarbide and monocarbide phases.

At tungsten exchanges of more than 80 atomic percent, or Mo exchanges of less than 20 atomic percent, the microstructures of the ascast alloys become increasingly coarse and, at about equivalent cooling rates from liquidus temperatures, have about the same hardness and microstructure as the commercially available product (FIG. 4, Table 1).

In summary, then, it can be seen from the foregoing discussions that, across the range of tungsten exchanges in the cubic high temperature carbide, two distinct composition ranges are in existence, within which particular kinetic and reaction phenomena can be used to advantage in the preparation of the carbide alloys of the invention. Within the first, which extends from the binary edge system Mo-C at about 40 to 42 at% C ($z \sim 0.67$ to 0.72), to tungsten exchanges of about 25 atomic percent, the cubic carbide solution can be retained by moderately rapid cooling (> 30° C per second) of the alloys from temperatures above 2000° C. The high temperature carbide is then transformed, usually in a separate heat treatment step, into a fine-grained mixture of hexagonal monocarbide and subcarbide at temperatures within the stability range of the monocarbide, typically between 1100° and 1400° C.

Within the second range, which extends between tungsten exchanges of approximately 57 to 72 atomic percent and carbon levels between about 38 and 40 atomic percent ($z \simeq 0.61$ to 0.67), extremely fine-grained and hard two-phased alloys consisting of hexagonal monocarbide and sub-carbide form at moderate cooling rates as a result of intermediate solid state reactions.

While alloys having gross compositions between these two composition ranges have advantages over the cast tungsten carbides because of their lower cost per unit volume, quenching rates of the same order as those employed in the fabrication of the cast tungsten carbides are necessary to achieve products of comparable hardness and wear-resistance.

Figure 2B:
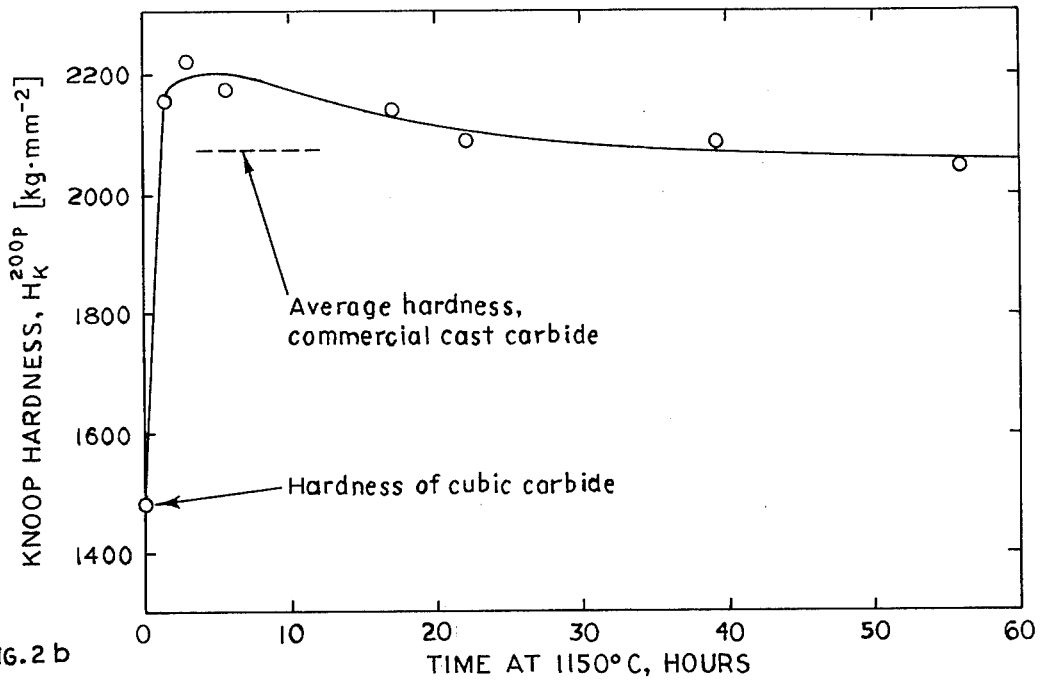
Figure 7:
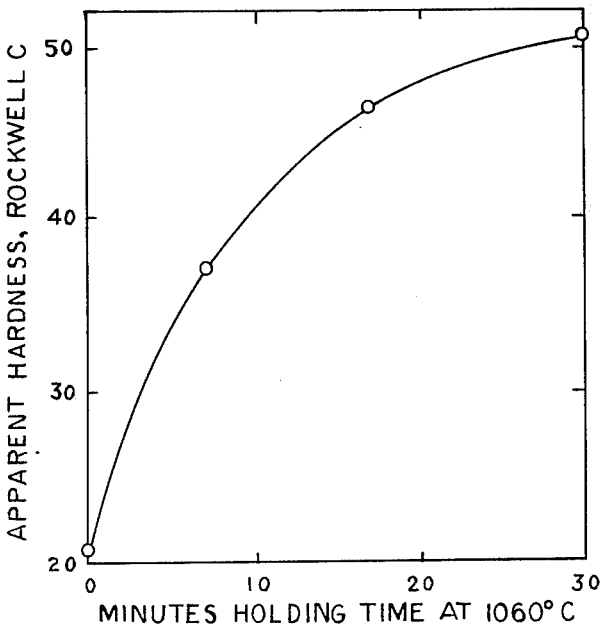
FIG. 7 is a graphical presentation of the macrohardness of a cemented carbide as a function of the exposure time at infiltration temperatures. The carbide, having a gross composition of $(Mo_{0.91}W_{0.09})C_{0.71}$, was formed by isothermal transformation of the cubic carbide solution at 1320° C; the initial composition of the infiltration alloy, in mole fractions, was $Cu_{0.45}Mn_{0.25}Ni_{0.23}Fe_{0.07}$.
Figure 4A:
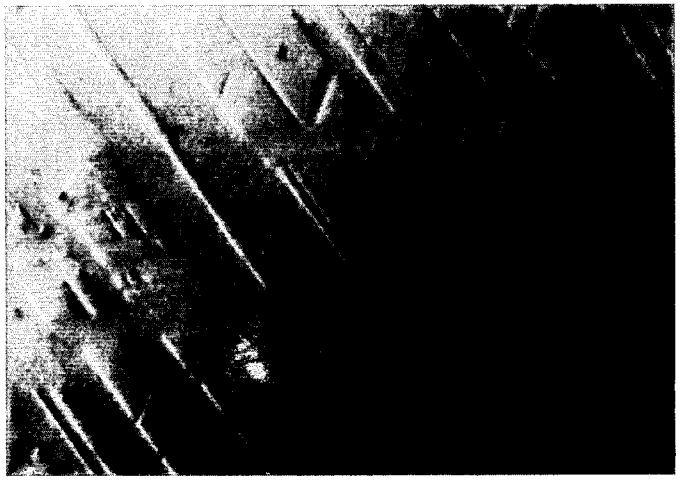
FIGS. 4*a* through 4*e* are microstructures, magnified 1000 times, of as-cast Mo-W-C alloys which were cooled at approximately the same rates from liquidus temperatures. The gross composition of the alloys are (FIG. 4*a*) -$MoC_{0.72}$.
Figure 4B:
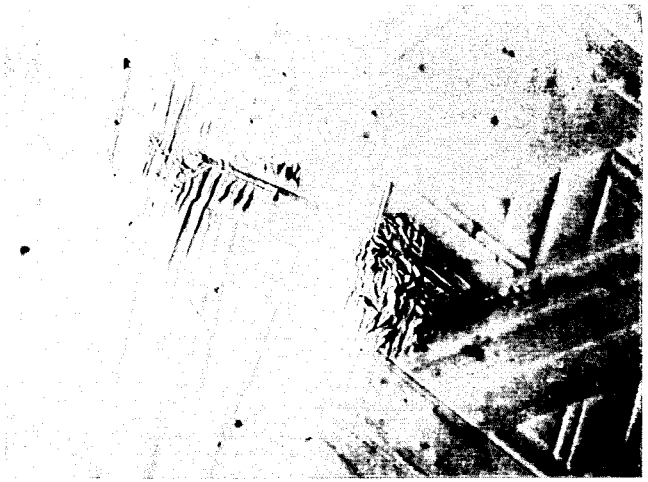

The cubic high temperature carbides are extremely brittle and friable alloys of comparatively low hardness (FIG. 2 and Table 1). Thus, for example, the Knoop hardness of the alloy $MoC_{0.72}$ increases from about 1480 kg/mm$^2$ for the cubic $\alpha$ - $MoG_{0.72}$, to approximately $H_K$ = 2200 kg/mm$^2$ after heat treatment for 1½ hours at 1150° C. In this state the transformation into $Mo_2C$ and MoC is about 90% complete, FIG. 2. The friability of the transformed structure, which consist of an intimately interlaced, fine-grained mixture of subcarbide and monocarbide, such as shown in FIG. 2*b*, is much less than that of the cubic carbide and the alloys, considering their high hardness, exhibit a considerable measure of toughness. Further aging of the transformer structure results in a slight increase of the grain size and a slight decrease in hardness, FIG. 2.

Figure 4C:
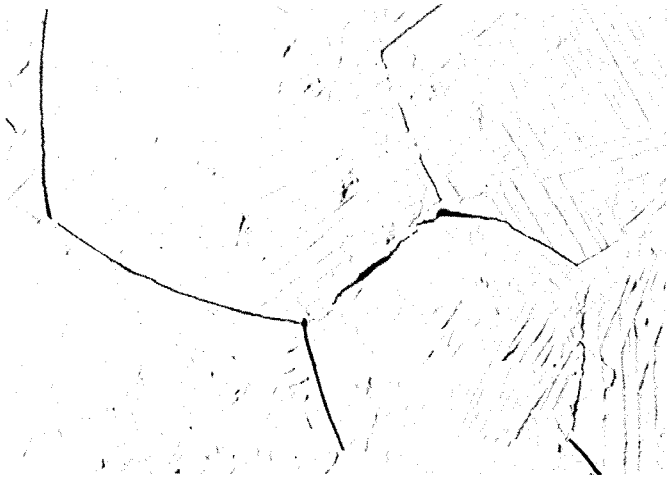
Figure 4D:
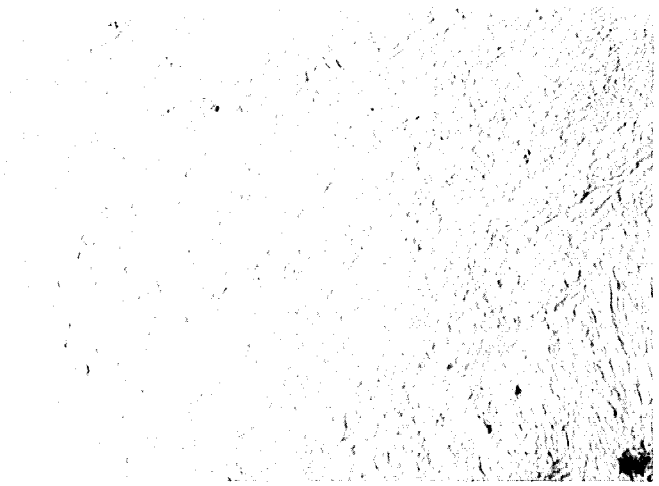
Figure 6:
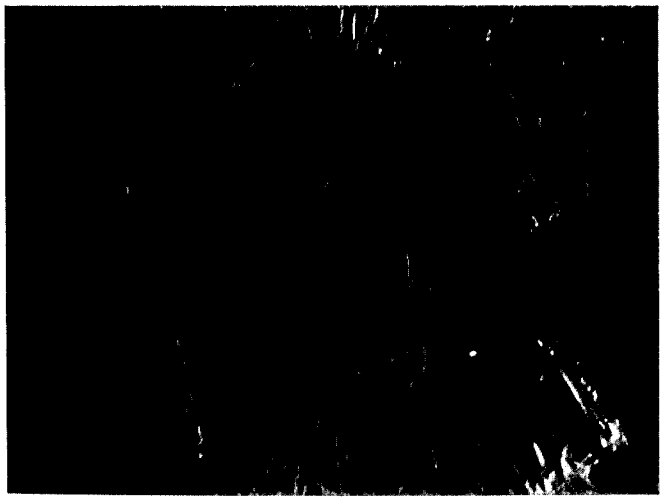
FIG. 6 is a micrograph, magnified 500 times, of a cemented carbide with a gross composition $(Mo_{0.85}W_{0.15})C_{0.715}$, which was fabricated by infiltration with a low melting copper base alloy. The carbide alloy was formed by isothermal transformation of the cast cubic carbide at 1300° C; the composition of the infiltration alloy, in mole fractions, was $Cu_{0.04}Mn_{0.27}Ni_{0.13}Cr_{0.10}$. The interaction zones visible around the large carbide grains and the small nodular grains of complex carbide dispersed within the infiltration alloy matrix have formed during a 12 minute holding time at 1150° C.

Alloying with tungsten somewhat increases the hardness of the cubic carbide as well as that of the transformed structure, Table 1. The highest hardness values, ranging between $H_K$ = 2700 and 2800 kg/mm$^2$, were obtained with alloys containing between about 60 to 72 atomic percent tungsten in exchange for molybdenum, which, as discussed further above and shown in FIG. 4*d*, are characterized by ultrafine grain structures. A further, albeit small, hardness increase in these alloys is possible by low level (< 10 at%) addition of chromium, Table 1.

The carbide alloys of the invention are preferably fabricated by melt-casting techniques similar to the methods employed in the fabrication of cast tungsten carbide. The alloys containing more than 25 atomic percent tungsten in exchange for molybdenum, hereinafter referred to as Type II carbide, are, after comminution to the desired grain size, used in as-cast condition, while cast alloys containing less than 25 atomic percent tungsten, hereinafter referred to as Type I carbide, are subjected to a heat treatment for several hours at 1000° to 1400° C to effect the transformation of the cubic carbide into hexagonal monocarbide and subcarbide.

A typical laboratory fabrication procedure for a Type I carbide is as follows:

A blended powder mixture [81 wt% $Mo_2C$, 17.25 wt% WC, and 1.75 wt% carbon; or, alternately, 76.2 wt% Mo, 16.2 wt% W, and 7.60 wt% carbon] corresponding to a gross composition $(Mo_{0.90}W_{0.10})C_{0.715}$ is loaded into the graphite crucible of a nonconsumable arcmelting furnace and melted under a helium-argon furnace atmosphere of ambient pressure. The melt is poured into carbon or cooled copper containers and the solidification product allowed to cool to room temperature.

Figure 3A:
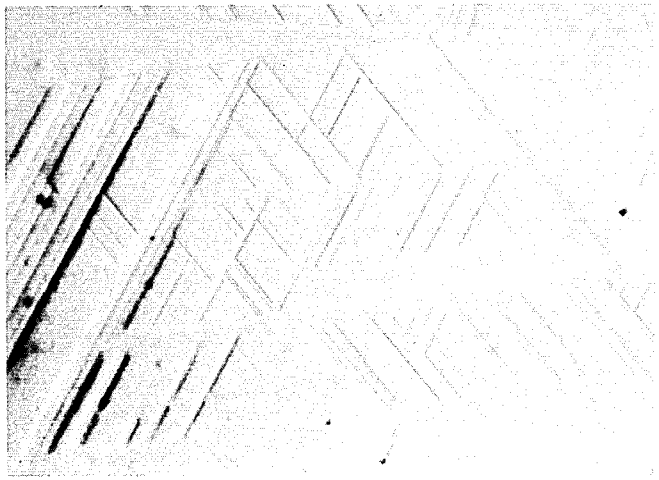
FIG. 3*a* is a micrograph, magnified 1000 times, of an alloy $(Mo_{0.975} W_{0.025})C_{0.72}$ in the as-cast condition.
Figure 3B:
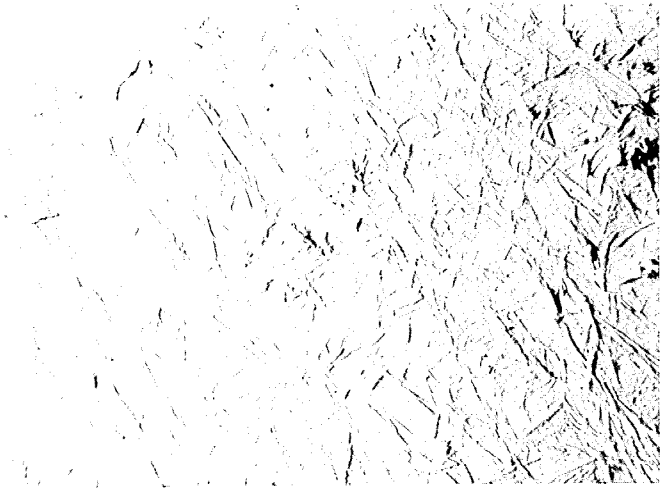
FIG. 3*b* is a microstructure, magnified 1000 times, of the same alloy as in FIG. 3*a*, but after an additional isothermal transformation treatment for 1 hr, at 1250° C.
Figure 4E:
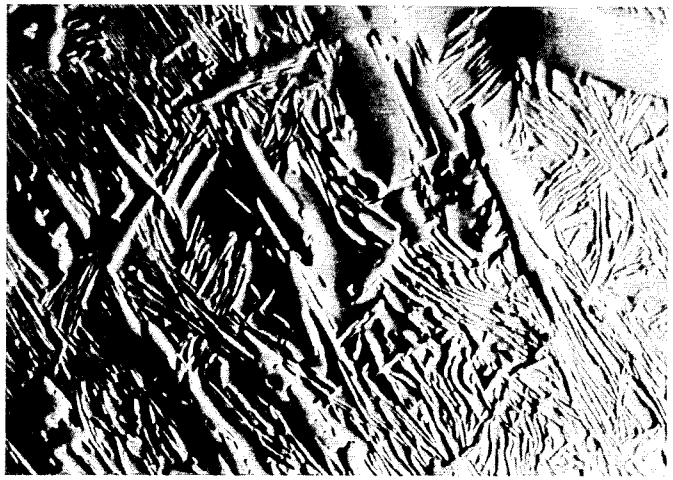

X-ray diffraction analysis of this intermediate product shows the pattern of a face-centered cubic lattice with a parameter of a = 4.260 to 4.2272A, accompanied at times by faint diffraction lines due to the presence of small quantities of the pseudocubic $\eta$ -(Mo, W)$_3$ C$_2$. The microstructure, of which the micrograph is FIG. 3*a* is a typical example, shows the characteristic pattern of $\alpha$ -(Mo, W)C$_{1-x}$ in the incipient transformation stage into $\eta$ -(Mo, W)$_3$ C$_2$. The Knoop hardness (200 p load) of the as-cast alloy typically lies between 1580 and 1630 kg/mm$^2$.

The cast pieces are then loaded into a graphite container and the assembly heated under vacuum or inert gas to about 1050° to 1100° C. After holding at this temperature for approximately ½ hour to permit the formation of a high nucleation density conductive to the formation of a fine microstructure, the temperature of the furnace is raised to 1300° to 1350° C and the transformation reaction allowed to go to completion over a 2-to 3-hour period.

X-ray diffraction analysis of the transformed product shows a phase mixture of subcarbide, (MoW)$_2$ C, and monocarbide, (Mo,W)C. The microstructure typically has the appearance of the transformer alloy shown in FIG. 3*b* and the average spacing between monocarbide and subcarbide grains under the chosen transformation condition is, in the average, less than 1 micron. The Knoop hardness of the alloy in the transformed state will vary between about 2160 to 2280 kg/mm$^2$.

A typical laboratory preparation procedure for a Type II carbide is as follows:

A blended powder mixture [19.2 wt% Mo$_2$ C, 57.8 wt% WC and 23 wt% W; or, alternately, 18.10 wt% Mo, 77.2 wt% W, and 4.70 wt% carbon] corresponding to a gross composition (Mo$_{0.31}$W$_{0.69}$)C$_{0.64}$ are melted and cast in the same manner as described for the Type I carbide. X-ray diffraction of the alloy in the as-cast condition shows the presence of subcarbide and hexagonal monocarbide only. The microstructure of the alloy typically has a grain spacing of less than 0.5 micron, FIG. 4*d*, and the Knoop hardness values range from 2680 to 2800 kg/mm$^2$.

Those skilled in the art can devise other methods, or variations of the above methods, to achieve a particular alloy; but, in whatever manner these alloys are fabricated, it is important that, for the Type I carbide, the cubic or pseudocubic high temperature carbides are retained during cooling and that the fine-grained carbide mixture is obtained through a transformation treatment, usually within the stability range of the hexagonal monocarbide phase as defined by the phase diagram in FIG. 1*a*. The principal requirements for the Type II carbide alloys are a sufficiently rapid cooling rate at temperatures below the stability limits of the cubic carbide solid solution as defined by the phase diagram in FIG. 1*a* so as to prevent the formation of coarser-grained, and therefore less hard and wear-resistant, alloys.

The acceptable grain size of the two-phased carbide structure of Type I and Type II carbides should be less than about 4 microns to achieve a hardness of at least about $H_k$ 2000.

The range of useful carbon contents extends from *z* values of about 0.60 to about 0.73. At carbon contents below this range the alloys are less hard and therefore less wear resistant because of proportionately larger amounts of the less hard subcarbide M$_2$ C. At carbon contents above this range the alloys contain excess graphite.

The carbide alloys of the invention, after comminution to suitable grain size ranges, can be combined in the same manner as the cast tungsten carbides with lower melting alloy binders to provide useful cemented alloys with high wear-resistance.

One class of such alloys are fabricated by infiltration of carbide powder packs with low melting alloys generally based on the elements Cu, Ag, Ni, Mn, Zn, and Sn. Typically in such alloys the combined content of these elements comprise more than 80 at.% of the alloy. In practice, infiltration of the carbide powder to form the cemented carbide, and bonding of the cemented carbide to the surface to be protected from wear such as steel, is usually done in one operation, the infiltrant alloy also serving as braze to bond the cemented carbide to the substrate. This alloy type, in combination with diamond grains in the surface layer, or throughout the matrix and in amounts up to about 40 vol % to further improve wear-resistance, is extensively used in oil-drilling and mining tools.

A second major application area for the cast tungsten carbides and the alloys of the invention is in hard facing alloys, which are extensively used in mining, earth moving, and agricultural operations. The binders in the hard facing alloys are usually low alloy steel or other ferrous metal alloys, such as nickel, or cobalt base, and the wear-resistance facings are commonly applied by weld-deposit techniques.

Whatever the application, the competitive application of the carbides of the invention with the cast tungsten carbide will be, besides cost, determined by two factors; wear-resistance and compatibility with low-melting metal binders with equivalent properties as those used in the commercial products. Other factors, such as wettability, oxidation resistance, etc., are of minor concern in this comparison, because of the very similar metallurgical, physical, and chemical properties.

Comparative measurements of the wear-resistance of cemented carbides were carried out with a standard wear-test apparatus using the Riley-Stoker test method. In this method, hereinafter referred to as Test Method A, a spinning metal or rubber wheel is pressed with a controllable force against the stationary test sample plate; an abrading medium in the form of a slurry of aluminum oxide or silicon carbide forms the interface between the rotating wheel and the test plate. The wear rate is determined by the amount of material worn from the test sample within a given time period and under predetermined conditions of contact pressure, rotation speed, and nature and grain size of the abrasive agent. In a second test method, hereinafter referred to as Test Method B, wear-resistance was determined by the weight loss of a silicon carbide or aluminum oxide grinding wheel relative to that of a test sample during grinding under predetermined conditions of wheel speed and feed rates.

The binder alloys used in the fabrication of the cemented carbides by the infiltration technique comprised commercial brazing alloys, commercial manganese bronzes, and alloys fabricated specifically to study the effect of different alloying additions upon infiltration characteristics and binder/carbide interaction. These experimental infiltration alloys generally were based on the alloy system Cu-Ni-Mn-Zn, and the principal alloying additions were iron and chromium. A selection of representative infiltration alloys is given in Table 2.

TABLE 2

Selected List of Representative Infiltration Alloys Used in the Fabrication of Cemented Carbide Test Samples*

| Alloy | Composition, Wt.% | Remarks |
|---|---|---|
| A' | Ag(50)-Cu(15.5)-Zn(15.5)Cd(16)-Ni(3) | Commercial brazing alloy |
| B' | Cu(58.5)-Zn(39.25)-Sn(1.0)-Mn(.25)-Fe(1.0) | Commercial manganese bronze |
| C' | Cu(58)-Zn(32.5)-Fe(1.0)-Mn(2.5)-Ni(5.0) | — |
| D' | Cu(70)-Zn(19)-Ni(5)-Fe(3)-Mn(2.5)-Sn(0.5) | — |
| E' | Cu(50)-Zn(39)-Ni(10)-Fe(1) | — |
| F' | Cu(50)-Zn(12.5)-Ni(12.5)-Mn(25) | — |
| G' | Cu(40)-Zn(10)-Ni(19.2)-Mn(30.8) | — |
| H' | Cu(14.5)-Mn(46.0)-Ni(39.5) | Brittle |
| I' | Cu(18)-Mn(39)-Ni(33.5)-Cr(9)-Fe(0.5) | Hard, $R_c$ 54 |
| J' | Cu(18)-Mn(39)-Ni(33)-Cr(4.8)-Fe(5.2) | — |
| K' | Cu(30)-Mn(32)-Ni(28)-Fe(10) | — |
| L' | Cu(61)-Mn(16)-Ni(11)-Zn(12) | — |
| M' | Cu(54)-Mn(16)-Ni(18)-Zn(12) | — |
| N' | Cu(46)-Mn(16)-Ni(26)-Zn(12) | — |

*0.5 wt % Si added for desoxidation to all alloys containing more than 10 wt% manganese.

These alloys were fabricated by melting mixtures of the constituent elements in the desired proportions, or mixtures of prealloyed commercial alloys, such as brasses, in a ceramic crucible in an induction furnace. To facilitate slag formation and also to provide a measure of desoxidation, 0.5 weight percent silican was added to the alloy batches containing higher concentrations of manganese. The furnace atmosphere in all instances was dry hydrogen.

A selection of carbide alloys employed in the preparation of the cemented carbide alloys is given in Table 3.

TABLE 3

Selected List of Carbide Alloys Used in the Fabrication of Cemented Carbide Test Samples

| Description | Composition, Relative Mole Fractions | State | Average Knoop hardness (200 p load) |
|---|---|---|---|
| A | $MoC_{.72}$ | As-cast, $\delta$ | 1470 |
| B | $MoC_{.72}$ | Transformed, $\beta + \epsilon$ | 2170 |
| C | $(Mo_{.95}W_{.05})C_{.718}$ | Transformed, $\beta + \epsilon$ | 2160 |
| D | $(Mo_{.90}W_{.10})C_{.715}$ | Transformed, $\beta + \epsilon$ | 2220 |
| E | $(Mo_{.90}W_{.10})C_{.64}$ | Transformed, $\beta + \epsilon$ | 2090 |
| F | $(Mo_{.82}W_{.18})C_{.71}$ | Transformed, $\beta + \epsilon$ | 2280 |
| G | $(Mo_{.77}W_{.23})C_{.705}$ | As-cast, $\delta$ + trace $\gamma$ | 1710 |
| H | $(Mo_{.77}W_{.23})C_{.705}$ | Transformed, $\beta + \epsilon$ | 2310 |
| I | $(Mo_{.54}W_{.46})C_{.68}$ | As-cast, $\beta + \epsilon$ | 2100 |
| J | $(Mo_{.31}W_{.69})C_{.65}$ | As-cast, $\beta + \epsilon$ | 2715 |
| K | $(Mo_{.15}W_{.85})C_{.64}$ | As-cast, $\beta + \epsilon$ | 2110 |
| L | Commercial cast tungsten carbide | As-received, $\beta + \epsilon$ | 2090 |

The as-cast, or as-cast and transformed, alloy materials were crushed and comminuted to yield mesh size ranges of 5 to 8, 8 to 10, 10 to 16, 16 to 42, 42 to 60, 60 to 100, 100 to 250, 250 to 325 and less than 325. Although a number of experiments using mixtures of the coarse-grained materials (5–42 mesh) were carried out for the purpose of demonstrating feasibility of particular alloy combinations as wear-facings on steel for earth-moving applications, the majority of test samples intended for the establishment of comparative wear data, were fabricated from carbide mixtures consisting of 70 percent by weight 60–100 mesh material and 30 percent by weight of a mesh size less than 250. The wear data comparisons of these test samples are shown in Table 4.

TABLE 4

Partial List of Cemented Carbide Compositions Prepared from the Carbide Alloys of the Inventions and Results of Comparative Wear Tests

| Alloy | Carbide Ingredient | Infiltrant Alloy | Infiltration Temperature | Wear Test Method | Relative* Wear Rate | Remarks |
|---|---|---|---|---|---|---|
| 1 | A | A' | 800–1000° C | n/a | n.d. | No infiltration |
| 2 | A | G' | 1140° C | A | 2 to 3 | Sluggish infiltration |
| | | | | B | 1 to 2 | |
| 3 | D | F' | 1090° C | A | 0.9 to 1.0 | — |
| | | | | B | 1.0 to 1.1 | — |
| 4 | F | I' | 1210° C | B | 0.8 to 1.0 | Partial dissolution of carbide |
| 5 | F | A' | 800° C | B | 0.8 to 0.9 | — |
| 6 | I | F' | 1100° C | A | 1.1 to 1.4 | Coarse-grained transformation structure |
| | | | | B | 1.0 to 1.5 | |
| 7 | B | F' | 1100° C | B | 1.0 to 1 | — |
| 8 | B | K' | 1260° C | B | 1.6 to 2.0 | Partial decomposition of carbide |
| 9 | J | L' | 1120° C | A | .6 to .8 | — |
| | | | | B | .7 to .8 | — |
| 10 | J | F' | 1100° C | B | .6 to .8 | — |
| 11 | K | F' | 1120° C | B | 1.0 to 1.1 | — |

TABLE 4-continued

| Alloy | Carbide Ingredient | Infiltrant Alloy | Infiltration Temperature | Wear Test Method | Relative* Wear Rate | Remarks |
|---|---|---|---|---|---|---|
| | | Partial List of Cemented Carbide Compositions Prepared from the Carbide Alloys of the Inventions and Results of Comparative Wear Tests | | | | |
| 12 | H | M' | 1170° C | B | 0.8 to 0.9 | — |
| 13 | G | N' | 1210° C | B | 1.0 to 1.3 | Transformed during preparation sluggish infiltration |
| 14 | J | E' | 1030° C | B | 0.9 to 1.1 | — |

*Relative wear rate data are in comparison with cast tungsten carbide prepared in identical manner and using the same carbide grain size, carbide volume loading, infiltrant alloy, and infiltration conditions.

Experimental hard facing electrodes were prepared by replacing the carbide filling in the tubular steel envelopes of commercial electrodes by a carbide alloy of the invention with the same grain size distribution and the same volume loading as the commercial product.

Typical procedures used in the fabrication of a cemented carbide alloy by infiltration with low melting melt binders, and the preparation of experimental welding electrodes, were as follows:

EXAMPLE 1

Fabrication of a Cemented Carbide

Figure 5:
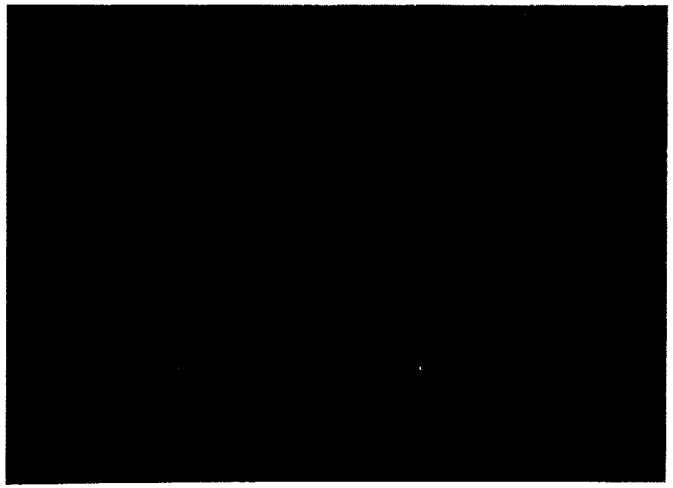
FIG. 5 is a microstructure, magnified 500 times, of a cemented carbide with a gross composition $MoC_{0.72}$, which was fabricated by infiltration with a low melting copper-base alloy. The carbide alloy was formed by isothermal transformation at 1150° C. of the cast cubic $\alpha$-$MoC_{0.72}$ to yield the fine-grained mixture of $Mo_2$ C and MoC; the composition of the infiltration alloy, in mole fractions, was $Cu_{0.50}Mn_{0.25}Ni_{0.13}Zn_{0.12}$.

A powder mixture with a sieve analysis of 60 wt% 16–24 mesh,20% 42–100 mesh, and 20% < 250 mesh powder of a transformed carbide with the gross composition $(Mo_{0.965}W_{0.035})C_{0.72}$ and a tapping density corresponding to 72% of the theoretical was packed into a graphite mold and the calculated amount of infiltrant alloy (Alloy F' in Table 2) placed on top of the powder pack. The assembly was heated under hydrogen. Infiltration was noted to commence at about 990° C and the last remnants of the infiltrant alloy had disappeared at 1060° C. The infiltrated alloy was then held for another 5 minutes at 1100° C to ensure complete and even distribution of the binder and then cooled within a 15 minute period to room temperature. The particular infiltrant alloy under the chosen infiltration conditions will result in a cemented carbide with a microhardness (Rockwell C scale) of typically $R_c$ 44 to 46 and a microstructure similar to that shown for the alloy in FIG. 5.

Increased holding times at temperatures above the solidus point of the binder hardening by reprecipitation of complex, nickel-and manganese-containing, carbides upon cooling. Thus, after a 30 minute additional exposure of the above-described cemented carbide at 1100° C, the macrohardness of the composite increased to about Rockwell C 50. Microscopic inspection of the alloy revealed that most of the smaller grains of the original carbide mixture have disappeared and that new carbide phases, usually appearing as small nodular grains dispersed within the matrix phase, have formed.

EXAMPLE 2 - Infiltrated Carbide Alloy Bonded to Steel Substrate

A carbide power mixture with the same composition and grain size distribution as described in Example 1 was packed into a machined cavity of a water hardening low alloy steel. The binder alloy was contained in a graphite cup placed on top of the powder pack. An infiltration path was provided by a small hole in the graphite container which was filled with < 42 mesh carbide powder for improved capillary action between the infiltrant melt and the surface of the packed carbide powder. Following infiltration under the same condition as before, the infiltrated assembly was cooled to 950° C, removed from the furnace, and water-quenched.

Post-quenching inspection of the cemented carbide-steel composite revealed a secure bond of the cemented carbide to the hardened steel and negligible interaction of the binder with the steel substrate. Because of the differential thermal expansion between steel and the carbide powder during initial heating and shrinkage of the cemented carbide during infiltration, a narrow transition zone of carbide-free infiltrant alloy is formed at the carbide-steel interface.

EXAMPLE 3, Infiltrated Carbide Alloy With Surface Layer of Diamonds

A monolayer consisting of 60 vol% of 40 to 60 mesh carbide powder 40 vol% of 40 to 60 mesh diamond powder was applied to the interior surface of a graphite mold with the aid of a commercial acrylic adhesive. After drying, the remainder of the die cavity was filled with the same carbide mixture, and infiltrated in the same manner, as described in Example 1. After completion of the infiltration, the assembly was held for an additional 15 minutes at 1100° C. Inspection of the composite part showed secure anchoring of the diamond grains in the cemented carbide matrix and no discernible signs for a dissolution of the diamond grains in the infiltration alloy matrix, or a transformation of the diamond into graphite.

Example 4. Preparation of an Experimental Hard Facing Electrode

A commercial hard facing electrode was found to consist of a steel tube weighing 25.1 gms and a cast tungsten carbide filling weighing 42.2 gms. The sieve analysis of the nominally 40 to 120 mesh carbide yielded the following size fractions: > 30 mesh, 4,5 wt%; 30 to 60 mesh, 53.2 wt%; 60 to 140 mesh, 25.4 wt%, 140 to 300 mesh, 16.3 wt%, and < 300 mesh, 0.6 wt%.

Figure 8A:
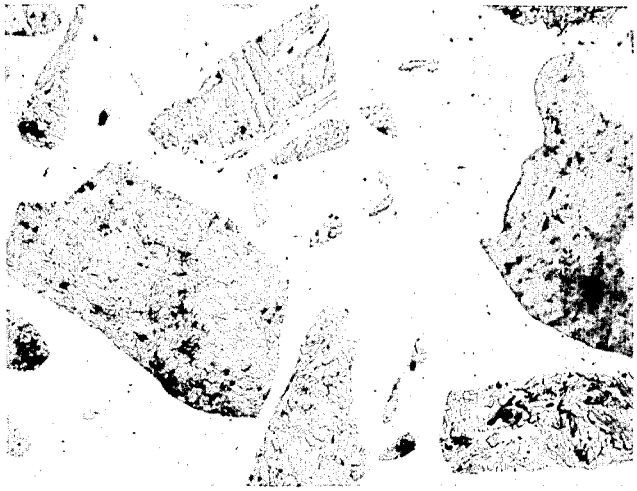
FIGS. 8*a* and 8*b* are micrographs, magnified 125 times, of wear-resistant weld deposits on steel, which were fabricated by a Heliarc process. The micrograph
Figure 8B:
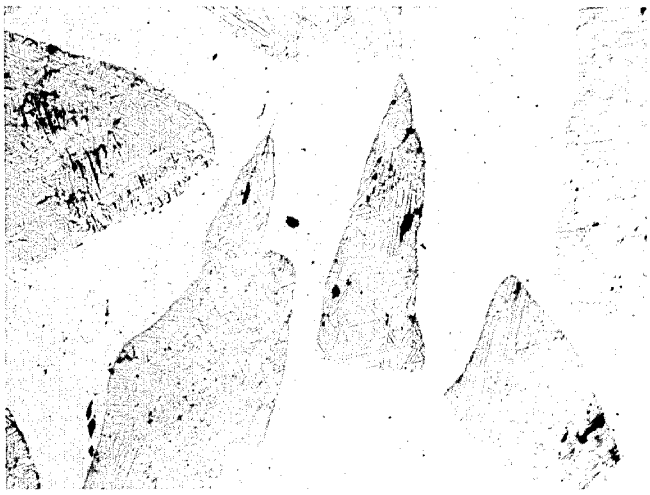

A transformed carbide with the gross composition $(Mo_{0.82}\ W_{0.18})\ C_{0.716}$ was sized to the same grain size distribution as the commercial carbide. To obtain the same volume ratio of carbide to steel, the steel tube was filled with 22.8 gms of the experimental carbide, yielding a specific carbide loading of 1.63 gms per inch electrode, as compared to 3 gms per inch for the tungsten carbide. Hard facing deposits using a heliarc technique yielded deposits, similar in appearance of the microstructures, FIG. 8. Hardness measurements at different depth levels of the hard facings yielded values of $R_c$ 63 to 67 for the experimental alloy, independent of the depth level. The hardness of the hard facing prepared from the commercial electrode increased from a low value of about $R_c$ 52 at the surface, to a high of about $R_c$ 66 to 69 near the steel substrate. Wear performance tests carried out according to test method A showed both hard facings to be equivalent.

The results of the extensive investigations concerning the effect of alloying additions upon the properties of the carbide alloys and comparable wear performance of the cemented carbides of this invention, representative examples of which are contained in the figures and tables of this specification, can be summarized as follows:

1. Within the appropriate composition range of the Mo-W-C system, wear-resistance of two phased carbides $M_2C$ + MC is only a function of hardness; the finer the grain structure of the alloys, the higher the apparent hardness and wear-resistance.
2. Hardness levels of $Mo_2C$ + MoC alloys formed by solid state transformation of the cubic carbide at 1100° to 1150° C are equivalent to cast WC + $W_2C$ tungsten carbides at comparable grain sizes of the constituent carbides.
3. Low-level (< 25 atomic percent) substitution of tungsten in the cubic molybdenum carbide, slightly increases hardness and wear-resistance of the transformation structure, but in particular improves the high temperature stability of the hexagonal monocarbide constituent in the alloy.
4. Carbide alloys with exceedingly small grain size and high hardness are formed from the cubic monocarbide solid solution at tungsten exchanges between about 57 to 72 atomic percent as a result of a four-phase isothermal reaction involving the $\eta$ -(Mo, W)$_3C_2$ high temperature phase. The hardness of these submicron carbides typically is 500 to 600 units, on the Knoop scale, higher than the commercial cast tungsten carbide, or the molybdenum-rich alloys formed by low temperature solid state transformation of the cubic carbide.
5. Low level (< 18 at%) chromium substitution for molybdenum and/or tungsten in the carbide alloys of the inventions stabilizes the cubic carbide solution to lower temperatures and decreases its rate of decomposition. Additions of chromium as a grain-refining agent are particularly useful at intermediate (30 to 50 atomic percent), and very high (> 80 atomic percent), tungsten levels because of the marked recrystallization tendency of these alloys. Additions of chromium to molybdenum-rich (> 80 atomic percent Mo) alloys are not recommended because of the marked destabilizing effect of chromium on the hexagonal monocarbide phase.
6. Additions of any cubic monocarbide stabilizers, such as elements of the group IV and group V refractory transition metals, to molybdenum-rich (> 75 at% Mo exchange) monocarbide alloys is detrimental to the disproportionation reaction and consequently to hardness and wear resistance of the transformed structures. Concentrations of up to 2 at% of group V metals (V, Nb, Ta) in tungsten-rich alloys are tolerable, but were not found to have any beneficial effects.
7. No significant difference in the reaction behavior between commercial cast tungsten carbides, binary $Mo_2C$ + MoC, and ternary (Mo, W)$_2$C + (Mo, W)C alloys, towards copper-based infiltration alloys of the types listed in Table 2 was found in the investigations.
8. Carbide alloys with molybdenum exchanges of more than 90 atomic percent are unstable at the melting temperature of ferrous alloy binders and dissolve rapidly. For adequate carbide stability in hard facing electrode applications, the tungsten exchange in the carbide should not be less than 15 atomic percent.
9. Infiltrated carbide alloys prepared from comminuted, cemented monocarbide solutions (Mo, W)C with 10 vol% Co generally showed a 15 to 25% lower wear-resistance than $M_2C$ + MC carbide aloys with identical binder content.

The data shown in the above discussed tables and graphs are representative of many other alloys prepared from carbide alloys within the range of the invention which were prepared and tested. It becomes evident from a comparison of performance data, especially when cost, raw material availability, and fabricability are taken into consideration, that the new carbide alloys of the invention offer a substantial advantages over the cast tungsten carbides of the state of the art designed for similar applications.

While the invention is thus disclosed and many embodiments described in detail, it is not intended that the invention be limited to phase embodiments. Instead, many embodiments and uses will occur to those skilled in the art which fall within the spirit of the invention and the scope of the appended claims.

Having thus described my invention, I claim:

1. A metal carbide composition $(Mo_xW_{x'}Cr_{x''})C_z$, in which the relative mole fractions x, x', x'' (x + X'+ x''= 1) of the metal components assume values of at least 0.20 for x, between 0 and 0.80 for x', and between 0 and 0.18 for x'' when x is less than about 0.80 and is 0 when x is greater than about 0.80, and the value of the stoichiometry parameter z, which stands for the number of gramatoms carbon present per gramatom of the metal component in the carbide alloy, lies between 0.60 and 0.73, said metal carbide composition being a two-phase mixture consisting of metal subcarbide, $M_2C$ and hexagonal monocarbide, MC, solid solution, wherein M represents the metal component, the average spacing between the grains of said subcarbide and said monocarbide phases in the mixture being less than 4 microns, and said two-phased mixture being formed by solid state decomposition of the pseudocubic $\eta$ -$M_3C_2$, or cubic $\alpha$ -$MC_{1-x}$, high temperature carbide solid solutions.

2. A cemented carbide composition comprising a carbide component according to claim 1, and a low-melting metal binder in which the combined contents of the elements copper, silver, nickel, manganese, and zinc comprise more than 80 atomic percent of said binder.

3. A wear-resistant composite in which the cemented carbide according to claim 2 is affixed to a metallic substrate for the purpose of increasing the wear life of the substrate.

4. A cemented carbide-diamond composite, in which the cemented carbide according to claim 2 contains up to about 40 volume percent diamonds.

5. A wear-resistant composite in which the cemented carbide according to claim 4 is affixed to a metallic substrate for the purpose of increasing the wear life of the substrate.

6. A welding electrode comprising the metal carbide composition of claim 1 combined with a ferrous metal alloy.

* * * * *

UNITED STATES PATENT OFFICE

CERTIFICATE OF CORRECTION

Patent No. 4,066,451 Dated 3 January 1978

Inventor(s) Erwin Rudy

It is certified that error appears in the above-identified patent and that said Letters Patent are hereby corrected as shown below:

Column 3, line 9, "$Cu_{0.04}$" should read --$Cu_{0.40}$--.

Column 5, line 50, "ascast" should read --as-cast--.

Column 6, line 23, "$MoG_{0.72}$"should read --$MoC_{0.72}$--.

Column 14, line 40, "phase" should read --phased--.

Signed and Sealed this

Eighteenth Day of April 1978

[SEAL]

Attest:

RUTH C. MASON
Attesting Officer

LUTRELLE F. PARKER
Acting Commissioner of Patents and Trademarks